United States Patent [19]

Miyasaka et al.

[11] 4,248,146

[45] Feb. 3, 1981

[54] IMPACT PRINTING APPARATUS HAVING PIVOTABLE FRAME STRUCTURES

[75] Inventors: Masao Miyasaka; Tsuneki Kobayashi, both of Katsuta, Japan

[73] Assignee: Hitachi Koki Company, Limited, Tokyo, Japan

[21] Appl. No.: 45,440

[22] Filed: Jun. 4, 1979

[30] Foreign Application Priority Data

Jun. 6, 1978 [JP] Japan ..... 53-68498

[51] Int. Cl.[3] ..... B41J 7/92

[52] U.S. Cl. ..... 101/93.03; 101/93.14; 400/58

[58] Field of Search ..... 101/93.03, 93.14; 400/55, 56, 57, 58, 59

[56] References Cited

U.S. PATENT DOCUMENTS

| | | | |
|---|---|---|---|
| 2,583,636 | 1/1952 | Dosban | 400/55 X |
| 3,730,082 | 5/1973 | Perry | 400/58 X |
| 3,960,074 | 6/1976 | Chov | 101/93.14 |
| 4,010,834 | 3/1977 | Linder | 101/93.03 X |
| 4,024,940 | 5/1977 | Hendrischk et al. | 400/56 |
| 4,057,011 | 11/1977 | Tramposch et al. | 101/93.03 |
| 4,086,997 | 5/1978 | Wu | 400/57 |
| 4,173,927 | 11/1979 | VanKempen et al. | 101/93.03 |

OTHER PUBLICATIONS

Blaskovic et al., IBM Tech. Discl. Bulletin, vol. 20, No. 11A, Apr., 1978, pp. 4270–4271.

*Primary Examiner*—Edward M. Coven

[57] ABSTRACT

An impact printing apparatus of the back-impact or front impact type having a frame construction composed of first and second frame structures positioned in a fore-and-aft direction of the apparatus and having impact hammers mounted on one of the frame structures, and a tiltable member positioned on one side of the frame structures, wherein the first frame structure is pivotally connected to the tiltable member about a vertical axis along one side end of the first frame structure and the tiltable member in turn is pivotally supported on the second frame structure about an axis in a lateral direction of the printing apparatus.

9 Claims, 9 Drawing Figures

IMPACT PRINTING APPARATUS HAVING PIVOTABLE FRAME STRUCTURES

FIELD OF THE INVENTION

The present invention relates to a printing apparatus and, more particularly, to an impact-type printing apparatus in which inked or otherwise printed impressions of letters, numerals or other graphic indicia are produced on a printing medium by means of impact hammers driven to strike against the printing medium or against printing fingers to be struck, in turn, against the printing medium.

DESCRIPTION OF THE PRIOR ART

Impact printing apparatus are largely categorized as a printing apparatus of the back-impact type in which the impact hammers are driven to strike against the reverse side of a printing medium with an ink ribbon or web interposed between a type carrier and the front face of the printing medium and a printing apparatus of the front-impact type in which the impact hammers are driven to strike against rear faces of printing fingers so that the printing fingers in turn are driven to strike against an ink ribbon or web contacting the front face of a printing medium which is pressed against a platen positioned on the reverse side of the printing medium. In order that a printing medium be imprinted clearly in an impact printing apparatus of this nature, it is important that the gap or clearance formed between the type carrier and the bank of the impact hammers in a printing apparatus of the back-impact type or between the platen and the bank of the printing fingers in a printing apparatus of the front impact type be properly adjusted to suit the thickness of the printing medium to be put to use or, if the printing medium is composed of two or more printing sheets interleaved with a sheet or sheets of carbon paper, the number of the printing sheets. A known printing apparatus of the back-impact or front-impact type is therefore provided with clearance adjusting means adapted to vary such a clearance depending upon the thickness of a printing medium or the number of the printing sheets to be put to use at a time. In a printing apparatus having such clearance adjusting means, it is required that the type elements carried on the type carrier of the apparatus be maintained in parallel with the front face of the printing medium in a printing area of the apparatus so that each of the type elements strikes flat against the printing medium with an ink ribbon or web interposed therebetween. To satisfy such a requirement, a prior-art impact printing apparatus of the back-impact type uses at least three frame structures consisting of a carrier support structure having the type carrier mounted thereon, a hammer support structure having the impact hammers mounted thereon and a frame structure supporting the carrier and hammer support structures in such a manner that the hammer support structure is movable toward and away from the carrier support structure so that the clearance between the type carrier and the bank of the impact hammers is variable depending upon the position of the hammer support structure relative to the carrier support structure. Provision of the three or more frame structures results in an unwieldy and cumbersome construction of the printing apparatus as a whole and gives rise to an increase in the production cost of the printing apparatus. The large-sized construction of the printing apparatus will also make severer the space requirement for the installation of the printing apparatus.

SUMMARY OF THE INVENTION

The present invention contemplates elimination of these drawbacks inherent in prior-art impact-type printing apparatus and, accordingly, it is a prime object of the present invention to provide an improved impact printing apparatus having clearance adjusting means but nevertheless featuring, inter alia, a small-sized, compact overall construction which is economical and easy to assemble.

In accordance with the present invention, such an object will be accomplished in an impact printing apparatus having a print line in a fore-and-aft direction of the printing apparatus and including a plurality of impact hammers which are arranged in a row substantially in parallel with the print line of the apparatus, wherein the improvement comprises first and second frame structures which are positioned in a fore-and-aft direction of the printing apparatus and which have the impact hammers mounted on one of the frame structures, a tiltable member positioned on one side of the first and second frame structures, first pivot means providing pivotal connection between the first frame structure and the tiltable member about a generally vertical axis along one side end of the first frame structure, second pivot means providing pivotal connection between the tiltable member and the second frame structure about an axis which is substantially parallel with the print line of the apparatus and which is fixed with respect to the second frame structure, an eccentric cam rotatable about an axis substantially parallel with the print line of the apparatus and fixed with respect to the second frame structure, the eccentric cam being in slidable engagement with the aforesaid tiltable member in a fore-and-aft direction of the printing apparatus, and control means which is operatively connected to the above mentioned eccentric cam for driving the eccentric cam to turn about the axis of rotation thereof. The improvement according to the present invention may further comprise loose fit or displacement limiting means providing adjustable connection between the second frame structure and the above mentioned tiltable member and limiting the amount of angular displacement of the tiltable member relative to the second frame structure about the axis of the pivotal connection therebetween, and/or a side member positioned on the other side of the first and second frame structures, and third pivot means providing pivotal connection between the side member and the second frame structure about an axis substantially aligned with the axis of the pivotal connection provided by the aforesaid second pivot means. The improvement thus made in an impact printing apparatus in accordance with the present invention may be incorporated into a printing apparatus of either the back-impact type or the front-impact type to simplify the frame construction of such a printing apparatus.

BRIEF DESCRIPTION OF THE DRAWINGS

The drawbacks inherent in prior-art impact printing apparatus and the features and advantages of an improved impact printing apparatus according to the present invention will be more clearly understood from the following description taken in conjunction with the accompanying drawings, in which.

DETAILED DESCRIPTION OF THE PRIOR ART

Figure 1:
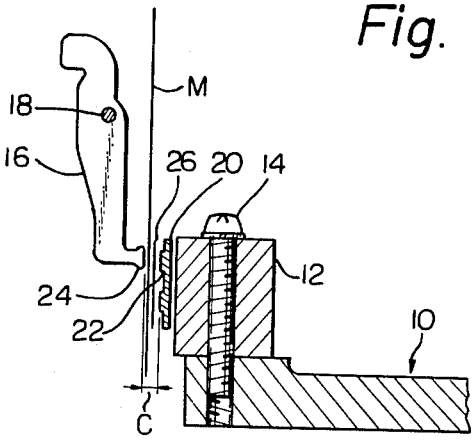
Fig. 1 PRIOR ART
FIG. 1 is a fragmentary sectional view schematically showing the basic construction of the printing mechanism of an ordinary printing apparatus of the back-impact type.

In FIG. 1 of the drawings, a printing apparatus of the back-impact type is shown including a generally horizontal, stationary support structure 10 having mounted on the upper face thereof a platen 12 which has a flat rear face and which is secured to the support structure 10 by suitable fastening means such as bolts 14. A plurality of impact hammers 16 are arranged in a row at the rear of the platen 12 and are pivotable independently of one another on a hammer support shaft 18 extending in parallel with the rear face of the platen 12. A flexible type carrier belt 20 supported in closed loop form over the upper face of the support structure 10 and having a series of type elements 22 attached to the continuous outer face thereof is movable in opposite directions over the support structure 10 partially along a straight rear travelling path parallel with the row of the impact hammers 16 and the rear face of the platen 12. Each of the impact hammers 16 has at one end thereof a striking head portion 24 projecting forwardly toward the above mentioned rear travelling path of the type carrier belt 20. When the impact hammers 16 are held in rest positions thereof, the striking head portions 24 of the impact hammers 16 are rearwardly spaced apart from the rear travelling path of the type carrier belt 20 so that a laterally elongated clearance C is formed between the bank of the impact hammers 16 and the type carrier belt 20 extending along the rear travelling path thereof. An ink ribbon 26 also mounted on the support structure 10 is arranged to longitudinally travel in part through this clearance C along the rear travelling path of the type carrier belt 20. During operation of the printing apparatus, a printing medium M consisting of a single printing sheet or a set of printing sheets interleaved with a sheet or sheets of carbon paper is vertically and intermittently fed between the ink ribbon 26 and the striking head portions 24 of the impact hammers 16 by means of a suitable paper feed mechanism. Though not shown in the drawings, each of the impact hammers 16 is associated with an electromagnetic hammer actuating unit electrically connected to a suitable source of digital printout signals. When one of these hammer actuating units is energized in response to a printout signal thus supplied from such a signal source, the impact hammer 16 associated with the particular hammer actuating unit is driven to turn about the hammer support shaft 18 and strikes at the front end of its striking head portion 24 against the reverse face of the printing medium M, which is as a consequence pressed onto one of the type elements 22 on the type carrier belt 20 across the ink ribbon 26 interposed between the particular type element 22 and the front face of the printing medium M. An inked impression of the character, numeral or other graphic indicium appearing on the selected one of the type elements 22 on the type carrier belt 20 is thus produced on the front face of the printing medium M and, if the printing medium M consists of a set of printing sheets interleaved with a sheet or sheets of carbon paper, a printed pattern conforming to such an inked impression is also produced on the front face of the printing sheet backing the sheet of carbon paper or each of the printing sheets respectively backing the sheets of carbon paper.

Figure 2:
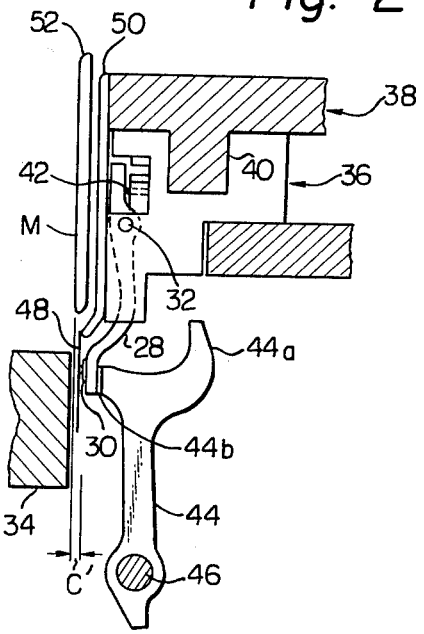
Fig. 2 PRIOR ART
FIG. 2 is a view similar to FIG. 1 but shows the basic construction of the printing mechanism of an ordinary printing apparatus of the front-impact type.

Turning to FIG. 2, a printing apparatus of the front-impact type is shown including a plurality of print fingers 28 each having or formed with a type element 30 at one end of the finger. The print fingers 28 are arranged in a row in front of a platen 34 having a flat front face and are pivotable independently of one another on a finger support shaft 32 extending in parallel with the front face of the platen 34. The finger support shaft 32 is supported by a type carrier 36 which is movable in opposite directions on a carrier support structure 38 having a guide rail portion 40 slidable in a groove formed in the type carrier 36. Each of the print fingers 28 thus mounted on the type carrier 36 is urged to turn about the axis of the finger support shaft 32 counterclockwise of the drawing, viz., in a direction to have its type element 30 moved away from the front face of the platen 34 by suitable biasing means such as a spring-loaded pressing element 42 projecting from the type carrier 36 into pressing engagement with the print finger 28 as shown. The printing apparatus shown in FIG. 2 further includes a plurality of impact hammers 44 arranged in a row below and forwardly of the bank of the print fingers 28 and pivotable independently of one another on a hammer support shaft 46 extending in parallel with the front face of the platen 34. Each of the impact hammers 44 is upwardly bifurcated to form front and rear arm portions **44*a* and 44*b*. The rear arm portion 44*b* of each impact hammer 44 projects toward the front face of the platen 34 and is engageable with one of the print fingers 28, while the front arm portion 44*a* of each impact hammer 44 is engageable with a suitable stop element (not shown) which is held in place at the rear of the front arm portion 44*a* for limiting the angular displacement of the print finger 44 toward the front face of the platen 34. Though not shown in the drawings, each of the impact hammers 44 thus arranged is held in engagement with an electromagnetically operated hammer actuating member and is driven to impact a selected one of the printing fingers 28 in response to a printout signal supplied from a suitable source (not shown) of digital printout signals. Though not shown, furthermore, suitable biasing means is provided to urge the impact hammers 44 to turn away from the front face of the platen 34 so that each of the type elements 30 on the print fingers 28 is forwardly spaced apart from the front face of the platen 34 by the force of the pressing element 42 when the actuating element engaging the impact hammer aligned with the print finger 28 is inoperative. When the print fingers 28 are thus forwardly spaced apart from the front face of the platen 34, there is a laterally elongated clearance C' formed between the front face of the platen 34 and the row of the type elements 30 on the print fingers 28. An ink ribbon 48 is arranged to longitudinally travel in part through this clearance C' with a printing medium M (which may consists of a single printing sheet or a set of printing sheets interleaved with a sheet or sheets of carbon paper) interposed between the front face of the printing medium M and the front face of the platen 34. When the actuating element engaging one of the impact hammers 44 of the printing apparatus thus constructed generally is operated to drive the impact hammer 44 to turn about the hammer support shaft 46 into striking engagement with the printing finger 28 aligned with the particular impact hammer 44, the printing finger 28 is driven to turn about the finger support shaft 32 against the force of the pressing element 42 and is caused to press the ink ribbon 48 at the rear end of the type element 30 mounted thereon. An inked impression of the character, numeral or other graphic indicia appearing on the particular type element 30 is thus produced on the front face of the printing medium M and, if the printing medium M consists of a set of printing sheets interleaved with a sheet or sheets of carbon paper, a printed pattern conforming to the inked impression is produced on the front face of the printing sheet backing the sheet of carbon paper or each of the printing sheets respectively backing the sheets of carbon paper. Designated by a reference numeral 50 in FIG. 2 is a cover plate attached to the carrier support structure 38 and covering the rear end of the type carrier 36 and by reference numeral 52 is a vertical guide plate for guiding the vertical movement of the printing medium M which is to be stepwise vertically fed between the ink ribbon 48 and the front face of the platen 34**.

Figure 3:
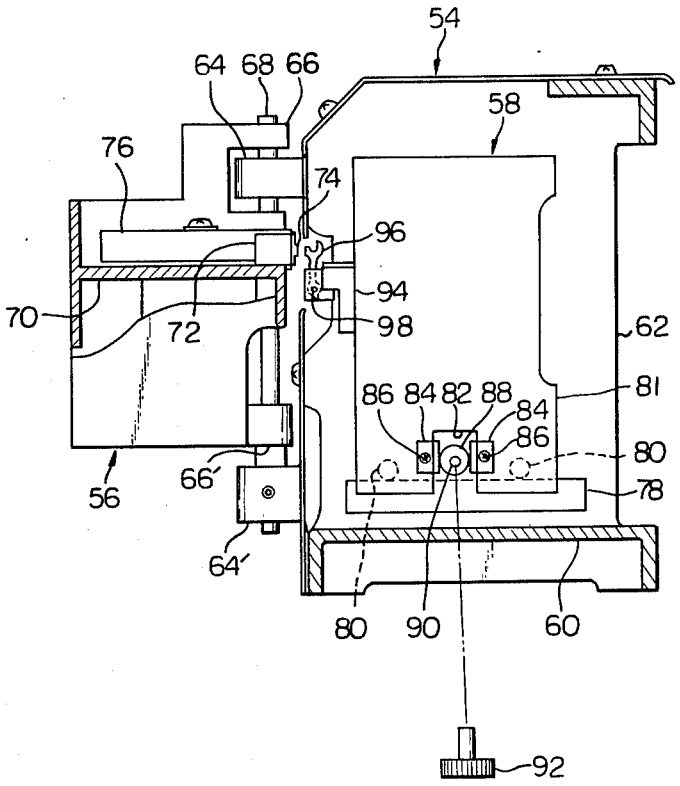
Fig. 3 PRIOR ART
FIG. 3 is a partially cut-away side elevation view showing the frame construction of a known back-impact printing apparatus having clearance adjusting means.

With respect to a printing apparatus of each of the types hereinbefore described, it is known that the number of the printing sheets to be used at a time ranges ordinarily from one to six and that the thickness of the printing medium consisting of a single printing sheet or a set of printing sheets interleaved with a sheet or sheets of carbon paper ranges ordinarily from about one twentieth to about one half of a millimeter. To assure the quality of printing on such a printing medium, it is important that the clearance C in the back-impact printing apparatus illustrated in FIG. 1 or the clearance C' in the front-impact printing apparatus illustrated in FIG. 2 be minutely adjustable depending upon the thickness of the printing medium M to be used on the printing apparatus or the number of the printing sheets to be used at a time on the printing apparatus. A printing apparatus having a basic construction illustrated in FIG. 1 or 2 is therefore provided with clearance adjusting means adapted to manually adjust the clearance C between the type carrier belt 20 and the bank of the impact hammers 16 in the printing apparatus of FIG. 1 or the clearance C' between the front face of the platen 34 and the row of the type elements 30 on the print fingers 28 in the printing apparatus of FIG. 2. FIG. 3 schematically shows a typical example of the frame construction of a known printing apparatus having such clearance adjusting means.

Referring to FIG. 3, the frame construction of the prior-art printing apparatus is composed of three frame structures which consist of a main frame structure 54, a type carrier support structure 56 hingedly or pivotally connected to the main frame structure 54, and an impact hammer support structure 58 enclosed within the main frame structure 54. The machine frame structure 54 includes a base member 60 at the bottom of the frame structure 54, a pair of spaced parallel side plates represented by a plate 62, and upper and lower brackets 64 and 64' projecting forwardly from one side portion of the frame structure 54. The brackets 64 and 64' are formed with holes or bores (not shown) which are vertically aligned with each other. The type carrier support structure 56 is positioned in front of the main frame structure 54 and has upper and lower arm portions 66 and 66' projecting rearwardly from one side portion of the support structure 56 and formed with holes or bores (not shown) which are also vertically aligned with each other. The type carrier support structure 56 is hingedly or pivotally connected to the main frame structure 54 by means of a pivot pin 68 vertically passed through the holes or bores in the brackets 64 and 64' of the main frame structure 54 and the arm portions 66 and 66' of the type carrier support structure 56. The type carrier support structure 56 further has a generally horizontal support plate 70 having supported thereon a laterally elongated platen or anvil 72 having a flat rear face at or adjacent the rear end of the support plate 70. On the support plate 70 are further mounted at least two belt drive pulleys for driving a type carrier band 74 to travel along the flat rear face of the platen 72 during operation of the printing apparatus. The belt drive pulleys, represented by a pulley 76, are rotatable each about a vertical axis over the upper face of the support plate 70 and are spaced apart from each other laterally of the support structure 56. One of the pulleys 76 is operatively connected to a suitable drive unit such as a motor (not shown) mounted on the underside of the support plate 70. The support plate 70 has further mounted thereon an ink ribbon and an ink ribbon drive and guide mechanism but, for simplicity of illustration, these are not shown in FIG. 3.

The main frame structure 54 has spaced parallel guide rails 78 extending above the base plate 60 of the frame structure 54 in fore-and-aft directions of the frame structure. The impact hammer support structure 58 is mounted on these guide rails 78 by means of rollers 80 and is, thus, movable in its entirety forwardly and rearwardly within the main frame structure 54 and accordingly relative to the type carrier support structure 56. The impact hammer support structure 58 has a pair of spaced parallel side plates represented by a side plate 81. Each of the side plates 81 is formed with a slot or recess 82 which is open at the lower end of the side plate and which is defined between two vertical edges spaced apart in parallel from each other in a fore-and-aft direction of the hammer support structure 58. The vertical edges thus defining the slot or recess 82 therebetween in each of the side plates 81 are reinforced by bearing plates 84, respectively, which are spaced apart a predetermined distance in the fore-and-aft direction of the support structure 58 and which are secured to the side plates 81 of the hammer support structure 58 by means of clamp screws 86. Two eccentric or off-center cam rollers represented by a cam roller 88 are securely mounted on a common, elongated cam shaft 90 and are angularly in phase with each other with respect to the center axis of the cam shaft 90. The cam rollers 88 are axially spaced apart a certain distance from each other on the cam shaft 90 and are slidably received each on the bearing plates 84 on each of the side plates 81. The cam shaft 90 supporting thereon the eccentric or off-center cam rollers 88 thus arranged has one axial end portion projecting outwardly from one side plate 62 of the main frame structure 54 and is securely connected at its extreme end to a control knob 92 adapted to be manually driven to turn about the center axis of the cam shaft 90. The printing apparatus shown in FIG. 3 is assumed to be of the back-impact type by way of example and, thus, the impact hammer support structure 58 further has a bracket 94 projecting forwardly toward the rear end of the type carrier support structure 56 and having mounted thereon a plurality of impact hammers 96 arranged in a row at the rear of the platen 72 on the carrier support structure 56. The impact hammers 96 are pivotable independently of each other on a shaft 98 parallel with the flat rear face of the platen 72 and are respectively engaged by electromagnetically operated hammer actuating elements (not shown) housed within the impact hammer support structure 58.

When the control knob 92 of the printing apparatus thus constructed generally is manually driven to rotate about the center axis of the cam shaft 90, the eccentric or off-center cam rollers 88 on the cam shaft 90 are caused to turn about the center axis of the cam shaft 90 and drives the impact hammer support structure 58 to move forwardly or rearwardly on the guide rails 78 forming part of the main frame structure 54. The impact hammer support structure 58 as a whole is thus moved toward or away from the type carrier support structure 56 over a distance continuously variable with the angle through which the knob 92 is turned about the center axis of the cam shaft 90. The movement of the impact hammer support structure 58 toward or away from the type carrier support structure 56 results in reduction or enlargement of the clearance between the bank of the impact hammers 96 on the hammer support structure 58 and the type carrier belt 74 on the carrier support structure 56 positioned in front of the hammer support structure 58. The clearance between the type carrier belt 74 and the bank of the impact hammers 96 can thus be minutely adjusted by manually rotating the knob 92. A printing apparatus of the nature hereinbefore described however has a drawback in that the apparatus requires the provision of three relatively large-sized structures for the frame construction thereof with the result that not only the frame construction is unwieldy and combersome but a disproportionately high production cost results from the costly elements required to fasten and join the individual frame and support structure together and from the time-consuming steps required for the assembly of such structures. The present invention aims at provision of an impact printing apparatus equipped with clearance adjusting means and nevertheless featuring a simple and economical frame construction.

DESCRIPTION OF A PREFERRED EMBODIMENT

Figure 4:
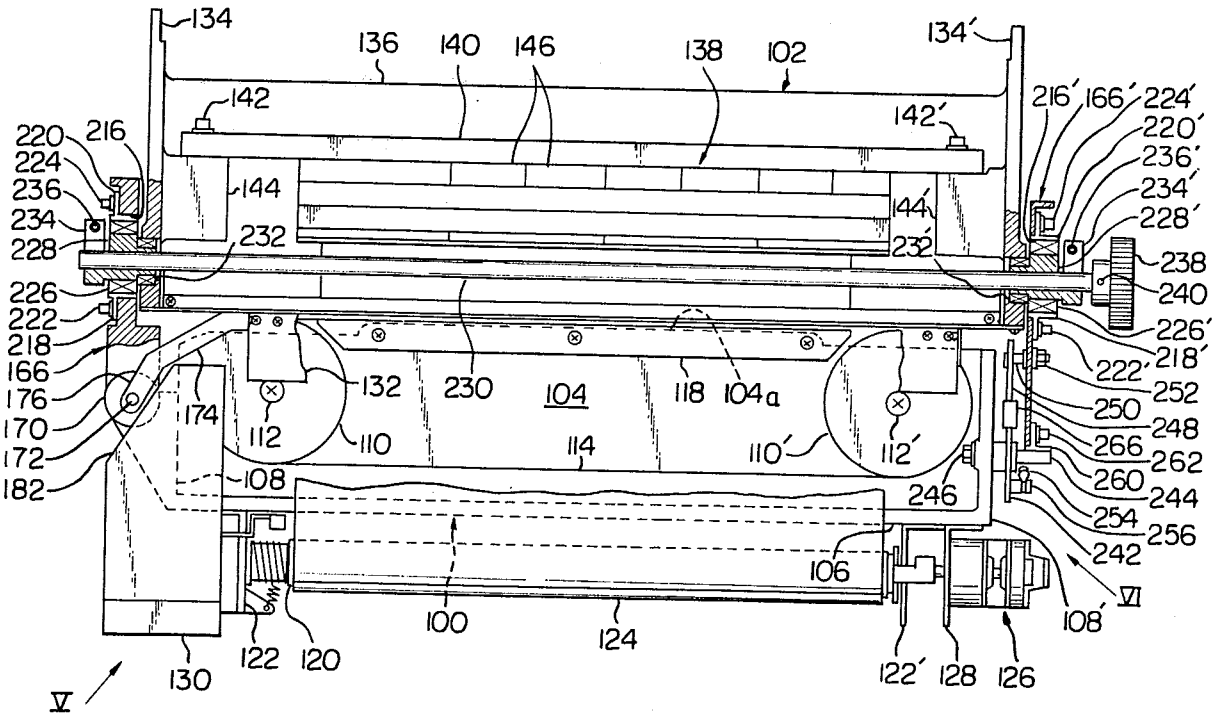
FIG. 4 is a plan view showing a preferred embodiment of an impact printing apparatus according to the present invention.
Figure 5:
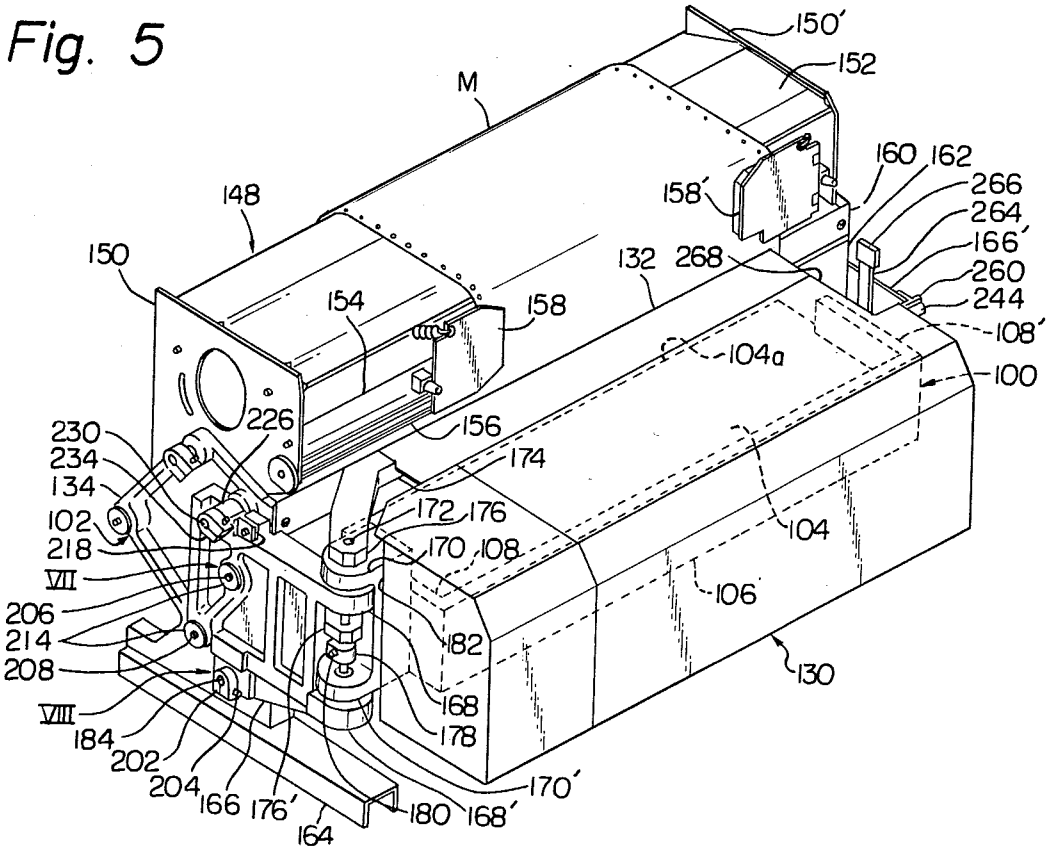
FIG. 5 is a perspective view showing the printing apparatus viewed downwardly in the direction of arrow V in FIG. 4.
Figure 6:
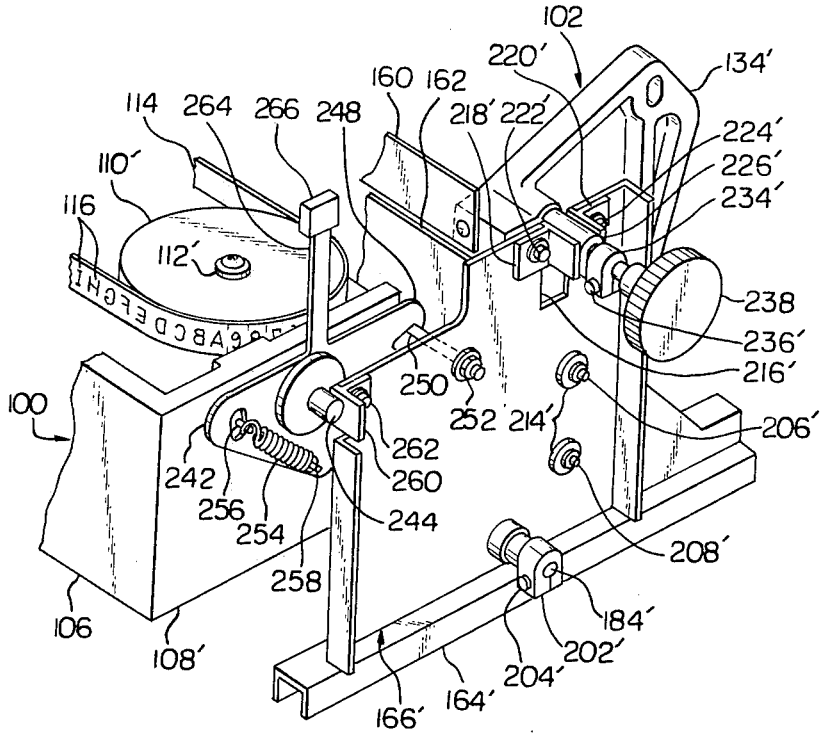
FIG. 6 is a fragmentary perspective view showing the printing apparatus viewed downwardly in the direction of arrow VI in FIG. 4.

Referring to FIGS. 4, 5 and 6 of the drawings, a preferred embodiment of the impact printing apparatus according to the present invention has a frame construction consisting essentially of first and second frame structures 100 and 102 positioned in a foreand-aft direction of the printing apparatus. The printing apparatus herein shown is assumed to be of the back-impact type by way of example and, thus, the first and second frame structure 100 and 102 of the printing apparatus are respectively constituted by a front type carrier support structure and a rear impact hammer support structure.

The first or front type carrier support structure 100 comprises a substantially horizontal, laterally elongated base plate 104 having a rear edge extending along and adjacent to the front end of the second or rear impact hammer support structure 102 as indicated by a broken line **104*a* in FIGS. 4 and 5. The type carrier support structure 100 further comprises a front wall portion 106 upstanding from the front end of the base plate 104 and spaced parallel side wall portions 108 and 108' upstanding respectively from the opposite lateral ends of the base plate 104 as will be best seen from FIG. 5**.

On the base plate 104 of the front type carrier support structure 100 thus configured are positioned a pair of pulleys 110 and 110' which are mounted on shafts 112 and 112', respectively, as shown in FIG. 4. The shafts 112 and 112' for the pulleys 110 and 110' are rotatably supported in vertical direction on the base plate 104 and are spaced apart a suitable distance from each other laterally of the type carrier support structure 100. One of the pulleys 110 and 110' is a driving pulley and is rotatable with the associated shaft 112 or 112', while the other pulley is a driven pulley and is rotatable on the associated shaft 112' or 112. The shaft 112 or 112' supporting the driving pulley is operatively connected to a suitable drive unit such as a motor (not shown) positioned underneath the base plate 104, and the shaft 112' or 112 for the driven pulley is either securely or rotatably mounted on the base plate 104. Between the pulleys 110 and 110' thus arranged on the base plate 104 of the type carrier support structure 100 is passed a flexible type carrier belt 114 of, for example, stainless steel. The type carrier belt 114 is passed in closed loop form between the pulleys 110 and 110' as will be seen from FIG. 4 and has formed on or attached to the continuous outer face thereof a series of type elements 116 which are arranged at regular intervals throughout the continuous length of the belt 114 as illustrated in part in FIG. 6. The type elements 116 thus formed on or attached to the type carrier belt 114 may be in the form of alphabetic letters, numerical characters and other graphic signs, marks or symbols useful for the graphic recording of information to be printed on a printing medium which is denoted by M in FIG. 5. As is well known in the art, each of the indicia formed by the type elements 116 on the type carrier belt 114 is a mirror image of the actual indicium to be imprinted by each type element. The printing medium M is shown in FIG. 5 as consisting of a single printing sheet for the simplicity of illustration but is herein assumed to consist of several sheets of printing paper interleaved with sheets of carbon paper. The type carrier support structure 100 has further mounted thereon a laterally elongated platen 118 extending along the rear edge **104*a* of the base plate 104 of the support structure 100 and having a substantially flat rear face at the rear end of the support structure 100 as shown in FIG. 4. The belt drive pulleys 110 and 110' mounted on the base plates 104 of the carrier support structure 100 are arranged so that the type carrier belt 114 is to longitudinally travel in part along and immediately at the rear of the flat rear face of the platen 118**. As is further illustrated in FIG. 4, an elongated ink web take-up cylinder 120 is detachably mounted on the front wall portion 106 of the carrier support structure 100 by means of brackets 122 and 122' secured to the outer face of the wall portion 106. The ink web take-up cylinder 120 extends in parallel with the flat rear face of the above mentioned platen 118 and is driven to stepwise turn about the center axis thereof by suitable intermittent-motion drive means (not shown) mounted on the carrier support structure 100. During operation of the printing apparatus, an ink web 124 having a width suitably larger than the width of the printing area behind the platen 118 is stepwise fed from the printing area and rolled on the take-up cylinder 120 by the intermittent-motion drive means as is well known in the art. To correct the path of the ink web 124 to advance toward the ink web take up cylinder 120, a correcting means such as a motor 126 is provided which is supported on the front wall portion 106 of the carrier support structure 100 by means of a bracket 128 and which has an output shaft engaging the take-up cylinder 120 as shown.

The type carrier support structure 100 thus supporting the belt drive pulleys 110 and 110', type carrier belt 114, platen 118 and ink web take-up cylinder 120 thereon is enclosed within a front cover 130 having an ink-web separator plate 132 laterally extending above and in parallel with the platen 118 on the support structure 100 as shown in FIG. 5. The ink-web separator plate 132 is adapted to hold the ink web 124 out of contact with the printing medium M in the printing area of the apparatus.

On the other hand, the second or rear impact hammer support structure 102 comprises a pair of spaced parallel side wall portions 134 and 134' and a rear cross wall portion 136 joining the side wall portions 134 and 134' as will be best seen from FIG. 4. The hammer support structure 102 has a hammer and hammer-actuator assembly 138 mounted on a cross member 140 secured by suitable fastening means such as screws 142 and 142' to lugs 144 and 144' projecting inboardly from the side wall portions 134 and 134', respectively, of the hammer support structure 102. Though not shown, the hammer and hammer-actuator assembly 138 includes a plurality of impact hammers arranged in a row at the rear of the flat rear face of the platen 118 on the type carrier support structure 100, and electromagnetically operated hammer actuator elements respectively engaging the impact hammers. The construction and arrangement of such a hammer and hammer-actuator assembly is well known in the art and is rather immaterial to the understanding of the gist of the present invention and is, for these reasons, not herein described and illustrated. In FIG. 4, it is assumed that the impact hammers are grouped into a suitable number of modules or units as schematically indicated at 146 in FIG. 4. The above mentioned printing area of the apparatus is formed between the bank of the impact hammers thus arranged and the flat rear face of the platen 118 on the type carrier support structure 100.

The printing apparatus embodying the present invention further comprises, as is customary, a paper feed mechanism for advancing the printing medium M (upwardly) in line increments. In FIG. 5, the paper feed mechanism is shown comprising a stationary housing 148 having a pair of spaced parallel side plates 150 and 150' adjacent the side wall portions 134 and 134', respectively, of the impact hammer support structure 102, an upper paper guide plate 152 laterally extending between the side plates 150 and 150' at the top of the housing 148, and a front cross member 154 laterally extending between the side plates 150 and 150' at the front end of the housing 148. An externally splined shaft 156 extends between the side plates 150 and 150' of the housing 148 and is journaled at the opposite axial ends thereof in bearings (not shown) mounted on the side plates 150 and 150' by means of bearing holders. The shaft 156 is thus rotatable about the center axis thereof on the side plates 150 and 150' of the housing 148 and, though not shown in the drawings, has a pair of sprocket wheels having teeth to fit into the perforations in the opposite marginal portions of the printing medium M or belt drive pulleys each having carried thereon an endless tractor belt having a series of pins or projections adapted to fit into the perforations in each marginal portion of the printing medium M. The splined shaft 156 supporting the sprocket wheels or the pulleys is operatively connected to suitable intermittent-motion drive means such as a stepping motor by, for example, a belt and pulley arrangement, though not shown. During operation of the printing apparatus, the intermittent-motion drive means is energized in timed sequence and drives the splined shaft 156 and accordingly the tractor wheels or the pulleys thereon to stepwise rotate about the axis of rotation of the shaft 156 so that the teeth of the tractor wheels or the pins or projections of the tractor belts successively enter the perforations in the printing medium M and cause the printing medium M to advance stepwise upwardly through the printing area of the apparatus. To assure the teeth of the tractor wheels or the pins or projections of the tractor belts to engage in the perforations in the printing medium M, there are provided a pair of spring-loaded retainer plates 158 and 158' for pressing the printing medium M onto the tractor wheels or belts. Since the paper feed mechanism thus including the housing 148, the externally splined shaft 156 and the tractor wheels or the combination of the pulleys and the tractor belts is well known in the art and is rather immaterial to the understanding of the subject matter of the present invention, description on further details of such a mechanism will not be herein incorporated. Furthermore, the construction and arrangement of the paper feed mechanism as hereinbefore described is merely by way of example and may therefore be modified in any desired manner or replaced with any other type of mechanism. In FIGS. 5 and 6, the housing 148 of the paper feed mechanism is shown to further comprise vertical upper and lower paper guide plates 160 and 162 laterally extending between the side plates 150 and 150' of the housing 148 immediately at the rear of the type carrier support structure 100. Indicated at 164 and 164' in FIGS. 5 and 6 are base members supporting the rear impact hammer support structure 102 along the lower ends of the side wall portions 134 and 134', respectively, of the hammer support structure 102.

In accordance with the present invention, the front type carrier support structure 100 is arranged to be tiltable in a fore-and-aft direction of the printing apparatus with respect to the rear impact hammer support structure 102 by means of a left-side tiltable member 166 (FIGS. 4 and 5) and a right-side tiltable member 166' (FIG. 6). As shown in FIGS. 4 and 5, the left-side tiltable member 166 is positioned adjacent in part to the side wall portion 108 of the type carrier support structure 100 and in part to the side wall portion 134 of the impact hammer support structure 102 and has forwardly projecting upper and lower bracket portions 168 and 168'. The upper and lower bracket portions 168 and 168' of the tiltable member 166 are vertically spaced apart from each other and are respectively formed with holes or bores vertically aligned with each other. The front type carrier support structure 100 also has upper and lower bracket portions 170 and 170' which project outwardly from the left side wall portion 108 of the support structure 100. Similarly to the bracket portions 168 and 168' of the left-side tiltable member 166, the upper and lower bracket portions 170 and 170' of the carrier support structure 100 are respectively formed with holes or bores vertically aligned with each other. The carrier support structure 100 thus provided with the bracket portions 170 and 170' is hingedly or pivotally connected along one lateral side of the support structure 100 to the left-side tiltable member 166 by means of a pivot pin 172 passed through the respective holes or bores in the brackets 168 and 168' of the tiltable member 166 and the brackets 170 and 170' of the carrier support structure 100. The upper and lower bracket portions 170 and 170' of the carrier support structure 100 being in slidable contact with the upper faces of the upper and lower bracket portions 168 and 168', respectively, of the tiltable member 166 as shown in FIG. 5, the type carrier structure 100 is supported in weight transmitting relationship on the left-side tiltable member 166. The pivot pin 172 thus providing pivotal connection between the carrier support structure 100 and the left-side tiltable member 166 is held in place on the bracket portions of the support structure 100 and the tiltable member 166 by means of a pin retaining member 174 having vertically spaced apart upper and lower arm portions 176 and 176' secured to the pivot pin 172. The pivot pin 172 is securely fitted at its upper end to the upper arm portion 176 of the pin retaining member 174 and at its intermediate portion to the lower arm portion 176' of the retaining member 174 by means of a U-shaped or slotted clamp element 178 forming part of or securely connected to the lower arm portion 176' and secured to the pivot pin 172 by a set screw 180. The pin retaining member 174 is fixedly connected by suitable fastening means to the previously described ink-web separator plate 132 forming part of the front cover 130 enclosing the carrier support structure 100 therewithin. The front cover 130 is formed with an opening 182 through which the bracket portions 170 and 170' of the carrier support structure 100 project outwardly from the front cover 130.

The front cover 130 is separate in construction from the rear impact hammer support structure 102. The front type carrier support structure 100 and the front cover 130 can therefore be turned as a single unit about the center axis of the pivot pin 172 away from the rear impact hammer support structure 102. Thus, the printing medium M can be set or re-set on the paper feed mechanism and the ink web 124 can be replaced with a new one easily by manually turning the carrier support structure 100 together with the front cover 130 about the center axis of the pivot pin 172 away from the housing 148 of the paper feed mechanism and thereby opening the printing area in front of the bank of the impact hammers on the hammer support structure 102.

Figure 8:
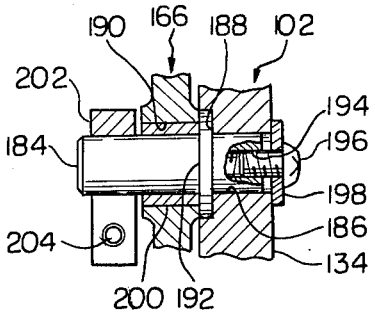
FIG. 8 is a sectional view showing, to an enlarged scale, the detailed construction of pivot means incorporated in the embodiment of the present invention as generally indicated at VIII in FIG. 5.

The left-side tiltable member 166 is pivotally mounted on the left side wall portion 134 of the rear impact hammer support structure 102 by means of a pivot pin 184 which is fitted to a lower end portion of the tiltable member 166 as shown in FIG. 5. As is illustrated to an enlarged scale in FIG. 8, the left side wall portion 134 of the hammer support structure 102 is formed with a hole 186 having a center axis in a lateral direction of the support structure 102 and axially open at the inner and outer side ends of the side wall portion 134, and an annular recess or depression 188 concentrically encircling the outer axial end of the hole 186, while the left-side tiltable member 166 is formed with a hole 190 which is slightly larger in diameter than the hole 186 in the side wall portion 134 of the support structure 102 and which is axially open at the inner and outer side ends of the above mentioned lower end portion of the tiltable member 166. The pivot pin 184 which has an annular flange 192 at its axially intermediate portion is inserted through the hole 190 in the tiltable member 166 into the hole in the side wall portion 134 of the support structure 102 with its flange 192 received in the annular recess or depression 188 in the side wall portion 134. The pivot pin 184 has an internally threaded or tapped axial hole 194 which is open at the inner axial end of the pin 184 in the hole 186 in the side wall portion 134 of the support structure 102. A screw 196 is screwed into this tapped axial hole 194 from the inner side of the side wall portion 134 with a washer 198 interposed between the head of the screw 196 and the inner face of the side wall portion 134, thereby securing the pivot pin 184 to the side wall portion 134 of the hammer support structure 102. In the hole 190 in the tiltable member 166 is disposed a sleeve 200 which slidably fits on an axially intermediate portion of the pivot pin 184 so that the tiltable member 166 as a whole is pivotable about the center axis of the pin 184 with respect to the side wall portion 134 of the hammer support structure 102 to which the pin 184 is fastened. To prevent the tiltable member 166 from being dislodged from its proper position in the axial direction of the pin 184, the pivot pin 184 has secured to its outer axial end portion projecting outwardly from the tiltable member 166 a generally U-shaped or slotted clamp element 202 by means of a set screw 204 as shown.

Figure 7:
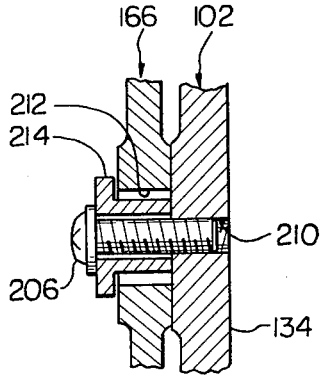
FIG. 7 is a sectional view showing, also to an enlarged scale, the detailed construction of loose fit or displacement limiting means provided in the embodiment of the present invention as generally indicated at VII in FIG. 5.

The angular displacement of the left-side tiltable member 166 which is thus arranged to be angularly movable with respect to the impact hammer support structure 102 about the center axis of the pin 184 is limited in the opposite directions of the displacement by displacement limiting means including two screws 206 and 208 which are fitted to the left-side tiltable member 166 and which are located on the tiltable member 166 in a predetermined positional relationship to the above described pivot pin 184. The screws 206 and 208 being arranged essentially similarly to each other, the arrangement of the screw 206 alone will be herein described with reference to FIG. 8. As illustrated in FIG. 7, the side wall portion 134 of the hammer support structure 102 is formed with an internally threaded or tapped hole 210 having a center axis in a lateral direction of the support structure 102 and axially open at the inner and outer side ends of the wall portion 134. On the other hand, the left-side tiltable member 166 is formed with a clearing hole 212 which is axially open at the opposite side ends of the tiltable member 166 and which is larger in diameter than the tapped hole 210 in the side wall portion 134 of the support structure 102. The screw 206 is passed loosely through the clearing hole 212 thus formed in the tiltable member 166 and is secured at its leading end portion into the tapped hole 210 in the side wall portion 134 of the support structure 102 so that the tiltable member 166 is movable to a limited degree with respect to the screw 206 and accordingly to the side wall portion 134 of the hammer support structure 102. The screw 206 is preferably provided with a flanged collar 214 disposed in the clearing hole 212 so as to dictate the position of the tiltable member 166 in the axial direction of the screw 206 by means of the flange portion of the collar 214 having the flange portion slidably interposed between the outer face of the tiltable member 166 and the head of the screw 206 as shown. The clearing hole 212 provided in the tiltable member 166 has been assumed to be circular in cross section but, if desired, may be in the form of a slot elongated generally in a fore-and-aft direction of the tiltable member 166. Briefly, the clearing hole 212 in the tiltable member 166 is such that a clearance is formed around the collar 214 or, if the collar 214 is not provided, around the screw 206 with respect to the tiltable member 166 and that such a clearance may be substantially uniform about the center axis of the screw 206 or may be elongated in a fore-and-aft direction of the tiltable member 166. The screws 206 and 208 thus fitted to the left-side tiltable member 166 and secured to the side wall portion 134 of the impact hammer support structure 102 are, thus, adapted to provide an allowance for the tiltable member 166 to turn about the center axis of the pivot pin 184 but to limit the angular displacement thus allowed of the tiltable member 166 in the opposite directions of the displacement.

The right-side tiltable member 166' as shown in FIG. 6, is arranged essentially similarly to the above described left-side tiltable member 166 in respect of its connection to the rear impact hammer support structure 102. Thus, the right-side tiltable member 166' is pivotally mounted on the right side wall portion 134' of the hammer support structure 102 by means of a pivot pin 184' arranged similarly to the pivot pin 184 on the left side of the hammer support structure 102 and the angular displacement of the tiltable member 166' with respect to the side wall portion 134' of the support structure 102 about the center axis of the pin 184' is limited in the opposite directions of the displacement by means of two screws 206' and 208' which are also arranged similarly to the screws 206 and 208 provided on the left side of the support structure 102, as will be seen from FIG. 6. In FIG. 6, the pivot pin 184' is shown to be fitted with a clamp element 202' similar to the above described clamp element 202 for the pivot pin 184 and each of the screws 206' and 208' constituting displacement limiting means for the right-side tiltable member 166' is fitted with a collar 214' which is also similar to the collar 214 in the arrangement illustrated in FIG. 8. The right-side tiltable member 166' is separate in construction from both of the carrier and hammer support structures 100 and 102 although the former is in engagement with the latter two.

The pivot pins 184 and 184' thus pivotally supporting the left-side and right-side tiltable members 166 and 166' on the stationary impact hammer support structure 102 have center axes substantially in line with each other across the hammer support structure 102. The left-side and right-side tiltable members 166 and 166' and accordingly the front type carrier support structure 100 hingedly connected along one of its side ends to the left-side tiltable member 166 are, therefore, rotatable as a single unit about an axis which is in part coincident with the respective center axes of the pivot pins 184 and 184' and which is fixed with respect to the stationary hammer support structure 102. The mentioned displacement limiting means including the screws 206, 208, 206' and 208' serve to limit the amount of angular displacement of the tiltable members 166 and 166' and the carrier support structure 100 thus rotatable about the axis aligned with the respective center axes of the pivot pins 184 and 184'. The screws 206 and 206' are axially aligned with each other and, likewise, the screws 208 and 208' are axially aligned with each other in lateral directions of the printing apparatus.

Referring continuedly to FIGS. 4, 5 and 6, the left-side and right-side tiltable members 166 and 166' are respectively formed with slots or recesses 216 and 216' which are substantially aligned with each other in a lateral direction of the printing apparatus and which are, in the arrangement herein shown, open at the upper ends of the tiltable members 166 and 166' as shown. A pair of bearing retaining elements 218 and 220 are closely attached to the outer face of the left-side tiltable member 166 by suitable fastening means such as screws 222 and 224, respectively. The bearing retaining elements 218 and 220 are located adjacent the front and rear vertical edges of the tiltable member 166 defining the slot or recess 216 therebetween and have respective lug portions projecting perpendicularly away from the outer side face of the tiltable member 166. The respective lug portions of the bearing retaining elements 218 and 220 are spaced apart in parallel from each other in a fore-and-aft direction of the printing apparatus and have formed therebetween a space open and contiguous to the slot or recess 216 in the tiltable member 166. To the outer side face of the right-side tiltable member 166' are also closely attached a pair of bearing retaining elements 218' and 220' by suitable fastening means such as screws 222' and 224', respectively. The bearing retaining elements 218' and 220' are arranged similarly to the above described bearing retaining elements 218 and 220 on the left-side tiltable member 166 and, thus, a space open and contiguous to the slot or recess 216' in the right-side tiltable member 166' is formed between the respective lug portions of the bearing retaining elements 218' and 220' as shown in FIG. 6. If desired, the bearing retaining elements 218 and 220 may be formed as integral portions of the tiltable member 166 and, likewise, the bearing retaining elements 218' and 220' may be formed as integral portions of the tiltable member 166' or, as an alternative, the bearing retaining elements 218, 220, 218' and 220' may be substituted by any other means if openings substantially aligned with each other in a lateral direction of the printing apparatus and each defined between vertical edges or faces spaced apart from each other in a fore-and-aft direction of the printing apparatus are formed in or through the left-side and right-side tiltable members 166 and 166', respectively.

Figure 9:
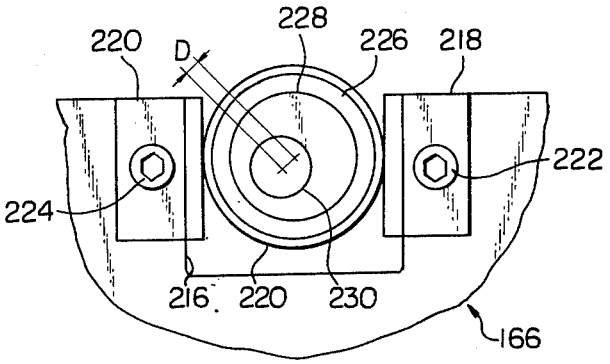
FIG. 9 is an axial end view showing an eccentric cam arrangement in the embodiment of the present invention.

A bearing 226 is snugly fitted in the open space thus formed between the bearing retaining elements 218 and 220 on the left-side tiltable member 166 and, likewise, a bearing 226' is snugly fitted in the open space formed between the bearing retaining elements 218' and 220' on the right-side tiltable member 166'. Eccentric cams 228 and 228' each having a circular cam lobe are rotatably received in these bearings 226 and 226', respectively, and are securely connected by a cam shaft 230 axially extending in a lateral direction of the printing apparatus as will be best seen from FIG. 4. The eccentric cams 228 and 228' have respective center axes offset a predetermined amount D from the center axis of the cam shaft 230 as indicated to an enlarged scale in FIG. 9 and are angularly in phase with each other with respect to the center axis of the cam shaft 230. The cam shaft 230 is further rotatably received in bearings 232 and 232' fitted to the side wall portions 134 and 134', respectively, of the impact hammer support structure 102 and is, thus, rotatable about the center axis thereof with respect to the stationary impact hammer support structure 102 as well as to the left-side and right-side tiltable members 166 and 166'. Each of the bearings 226, 226', 232 and 232' thus arranged is preferably constituted by a needle bearing. The cam shaft 230 has opposite axial end portions projecting outwardly from the bearings 226 and 226' on the left-side and right-side tiltable members 166 and 166', respectively. The eccentric cams 228 and 228' have generally U-shaped or slotted clamp portions 234 and 234', respectively, which are tightened to these projecting axial end portions of the cam shaft 230 by means of set screws 236 and 236', respectively. Each of the eccentric cams 228 and 228' thus arranged may be constructed as an integral portion of the cam shaft 230, if desired. On the right side of the printing apparatus, the cam shaft 230 further projects axially outwardly from the eccentric cam 228' and is securely connected at its end to a control knob 238 by means of a set screw 240. Thus, the cam shaft 230 and accordingly the eccentric cams 228 and 228' can be manually driven to turn about the center axis of the cam shaft 230. When the cam shaft 230 and the eccentric cams 228 and 228' are thus driven to turn about the center axis of the cam shaft 230, each of the eccentric cams 228 and 228' forces the associated bearing 226 or 226' against the inner face of one of the bearing retaining elements 218 and 220 or the bearing retaining elements 218' and 220' while turning about the fixed axis of rotation of the cam shaft 230. The left-side and right-side tiltable members 166 and 166' are therefore forced to move in their entireties either forwardly or rearwardly with respect to the stationary impact hammer support structure 102 depending upon the direction in which the cam shaft 230 is turned by the knob 238. The forward or rearward displacement of the left-side and right-side tiltable members 166 and 166' thus caused is accompanied by the movement of the front type carrier support structure 100 in a fore-and-aft direction of the printing machine so that the type carrier belt 114 mounted on the carrier support structure 100 is moved toward or away from the bank of the impact hammers mounted on the stationary hammer support structure 102 by a distance dictated by the angle through which the control knob 238 is manually turned about the center axis of the cam shaft 230. The clearance formed between the bank of the impact hammers on the stationary hammer support structure 102 and the type carrier belt 114 extending along the rear face of the platen 118 on the type carrier support structure 100 is in this fashion adjustable by manually turning the control knob 238.

The movement of each of the tiltable members 166 and 166' and the type carrier support structure 100 thus moved in a fore-and-aft direction of the printing apparatus is exactly the angular displacement of each of them about an axis aligned with the respective center axes of the pivot pins 184 and 184' by means of which the tiltable members 166 and 166' are pivotally connected to the stationary hammer support structure 102. The type carrier belt 114, as well as any other members mounted on the type carrier support structure 100, is, for this reason, moved cross sectionally in an arc about such an axis of rotation of the tiltable members 166 and 166'. Since, however, the distance between the axis of rotation of the tiltable members 166 and 166' and the type carrier belt 114 extending along the printing area of the apparatus, viz., the radius of rotation of the type carrier belt 114 about the axis of rotation of the tiltable members 166 and 166' is sufficiently large as compared with the amount of displacement of the type carrier belt 114 with respect to the axis of rotation of the tiltable members 166 and 166', the change in the angular position of the type carrier belt 114 with respect to the stationary hammer support structure 102 is negligibly small. The type carrier belt 114 moved together with the tiltable members 166 and 166' and the carrier support structure 100 is, therefore, allowed to remain substantially parallel in cross section with a vertical plane so that each of the impact hammers on the stationary hammer support structure 102 is allowed to strike flat against the type carrier belt 114 after the position of the carrier support structure 100 relative to the stationary hammer support structure 102 has been adjusted. The amount of displacement of the tiltable members 166 and 166' and the carrier support structure 100 with respect to the stationary hammer support structure 102 is limited by the displacement limiting means constituted by the screws 206, 208, 206' and 208' as previously described.

In order to hold the position of the type carrier support structure 100 once adjusted for proper position with respect to the stationary hammer support structure 102, the printing apparatus embodying the present invention further comprises position holding means arranged on the right-hand side of the carrier support structure 100 to achieve this purpose. As illustrated in FIG. 6 of the drawings, the position holding means comprises a position retaining member 242 disposed between the right side wall portion 108' of the carrier support structure 100 and the right-side tiltable member 166' which is spaced in parallel from the outer face of the side wall portion 108' of the carrier support structure 100. The position retaining member 242 is rotatably mounted on the side wall portion 108' of the support structure 100 by means of a pin 244 axially projecting from the wall portion 108' in a lateral direction of the printing apparatus. The pin 244 is secured to the side wall portion 108' of the support structure 100 by suitable fastening means such as a screw 246 as shown in FIG. 4. The position retaining member 240 has a hook portion 248 extending rearwardly from the pin 244 and engageable with a hook retaining pin 250 axially projecting laterally inwardly from the inner face of the right side tiltable member 166' and securely connected to the side wall portion 108' by suitable fastening means such as a nut 252. The position retaining member 242 is urged to turn about the center axis of the pin 244 in a direction to have the hook portion 248 held in engagement with the hook retaining pin 250 by suitable biasing means such as a preloaded helical tension spring 254 which is shown anchored at one end to a pin 256 secured to the side wall portion 108' of the support structure 100 through an opening formed in the retaining member 242 and at the other end to a pin 258 secured to the retaining member 242. The position retaining member 242 and the hook retaining pin 250 are arranged so that, when the hook portion 248 of the position retaining member 242 is held in engagement with the hook retaining pin 250 by the force of the tension spring 254, the type carrier support structure 100 hingedly or pivotally supported on the left-side tiltable member 166 by the pivot pin 172 assumes a proper fore-and-aft position substantially perpendicular to the left-side and right-side tiltable members 166 and 166', viz., substantially parallel to the printing area of the apparatus. The carrier support structure 100 is prevented from being moved rearwardly from such a proper fore-and-aft position relative to the tiltable members 166 and 166' by means of a stop element 260 securely mounted on the right-side tiltable member 166' by suitable fastening means such as a screw 262 and located so that the pin 244 having the position retaining member 242 on the side wall portion 108' of the support structure 100 is engaged at its rear end by the stop element 260 when the carrier support structure 100 is in the proper fore-and-aft position with respect to the left-side and right-side tiltable members 166 and 166'. If desired, the stop element 260 may be constructed as an integral portion of the tiltable member 166' and may be arranged to be engaged not by the pin 244 supporting the position retaining member 242 but by any member independent of the pin 244 and suitably secured to the position retaining member 242.

The position retaining member 242 further has an arm portion 264 extending substantially upwardly from the pin 244 and connected at its upper end to a handle 266. The front cover 130 illustrated in FIG. 5 is formed with an opening or recess 268, through which the arm portion 264 of the position retaining member 242 projects upwardly from the front cover 130 and is movable forwardly and rearwardly with respect to the front cover 130. Thus, the position retaining member 242 can be manipulated to disengage the hook portion 248 thereof from the hook retaining pin 250 on the right-side tiltable member 166' of the carrier support structure 100 by manually pulling the handle 266 above the front cover 130. When the arm portion 264 of the position retaining member 242 is thus manually moved forwardly above the front cover 130 by the operator of the printing apparatus and as a consequence the position retaining member 242 is disengaged from the hook retaining pin 250, the type carrier support structure 100 is disengaged from the right-side tiltable member 166' and can be pivotally moved together with the front cover 130 away from the rear stationary hammer support structure 102 about the pivot pin 172 on the left-side tiltable member 166, providing easy access to the printing area of the apparatus during exchange of the printing medium M or the ink web 124 with a new one as previously noted.

As will have been appreciated from the foregoing description, one of the outstanding features of the impact printing apparatus embodying the present invention is that the front type carrier support structure 100 can be pivotally moved away from the rear stationary impact hammer support structure 102 so that exchange of the ink web 124 or the printing medium M can be effected with utmost ease. The type carrier support structure 100 thus moved away from the hammer support structure 102 can be moved back into the original position thereof accurately and reliably by the position holding means including the position retaining member 242, hook retaining pin 250, spring 254 and stop element 260.

Another outstanding feature of the printing apparatus proposed by the present invention is that the fore-and-aft position of the front type carrier support structure 100 with respect to the stationary rear impact hammer support structure 102 can be minutely and steplessly adjusted simply by causing the control knob 238 to turn about the center axis of the cam shaft 230 manually or by the use of powered drive means such as motor. The movement of the carrier support structure 100 to produce such a change of the fore-and-aft position of the carrier support structure 100 with respect to the stationary hammer support structure 102 is an angular displacement of the former about an axis fixed with respect to the latter but the angular position, in cross section, of the type carrier belt 114 on the carrier support structure 100 with respect to the hammer support structure 102 is maintained substantially unchanged since the radius of rotation of the carrier support structure 102 about such a fixed axis is sufficiently long as compared to the amount of displacement of the support structure 100 in a fore-and-aft direction of the printing apparatus. Since, furthermore, due to the fact that the ink web separator plate 132 forming part of the front cover 130 is to be moved together with the type carrier support structure 100 with respect to the stationary hammer support structure 102, the blocking of the impact hammers can be prevented which would otherwise happen to be interfered with by the rear edge of the ink web separator plate 132 during movement into and out of their printing positions.

While only one preferred embodiment of an impact printing apparatus according to the present invention has been described and shown, it should be borne in mind that such an embodiment is merely by way of example and that the embodiment herein shown may be changed and/or modified in numerous manners. If desired, for example, the general arrangement of the type carrier and impact hammer support structures 100 and 102 may be modified so that the type carrier support structure 100 is held stationary and the impact hammer support structure 102 is hingedly or pivotally connected along one of the side ends thereof to the stationary type carrier support structure 100. Furthermore, the left-side and right-side tiltable members 166 and 166' which have been described to be piv-pivotally connected to the stationary hammer support structure 102 by means of pivot pins 184 and 184' may be arranged to be linearly movable or slidable with respect to the hammer support structure 102 in a fore-and-aft direction of the printing apparatus. In this instance, the means providing pivotal connection between the stationary hammer support structure 102 and each of the left-side and right-side tiltable members 166 and 166' may be replaced with suitable rollers supporting the tiltable member thereon and rollable on a guide rail fast on the hammer support structure 102.

While, furthermore, the present invention has been described and shown to be embodied in an impact printing apparatus of the back-impact type, it is apparent that the essential features of the present invention can be incorporated into not only an impact printing apparatus of such a type but into an impact printing apparatus of the front-impact type constructed and arranged basically as illustrated in FIG. 2. It may be added that the present invention is also applicable to an impact printing apparatus using a type carrier drum adapted to present type elements on a vertical plane in the printing area of the apparatus and/or an ink ribbon arranged to travel in a lateral direction along the printing area of the apparatus.

What is claimed is:

1. In an impact printing apparatus having a print line in a lateral direction of the apparatus and including a plurality of impact hammers arranged in a row substantially in parallel with said print line, the improvement comprising first and second frame structures positioned in a fore-and-aft direction of the printing apparatus, impact hammers operably mounted on one of said frame structures, a tiltable member positioned at one side of said first and second frame structures, first pivot means positioned at a side end of said first frame structure, said first pivot means operably pivotally interconnecting said first frame structure and said tiltable member about a generally vertical axis along said one side end of said first frame structure, second pivot means operably pivotally interconnecting said tiltable member and said second frame structure for pivoting movement about an axis substantially parallel with said print line and fixed with respect to said second frame structure, an eccentric cam mounted for rotation about an axis substantially parallel with said print line and being fixed with respect to said second frame structure, said eccentric cam being in slidable engagement with said tiltable member and upon rotation causing movement of said tiltable members and commensurate with fore-and-aft movement relative of said frames in a fore-and-aft direction of the printing apparatus, and control means operatively connected to said eccentric cam for driving the eccentric cam to turn about the axis of rotation thereof.

2. The improvement as set forth in claim 1, further comprising loose fit means providing adjustable connection between said second frame structure and said tiltable member and limiting the amount of angular displacement of the tiltable member relative to the second frame structure about said axis of the pivotal connection therebetween.

3. The improvement as set forth in claim 1, further comprising a side member positioned on the other side of the first and second frame structures, and third pivot means operatively interconnecting and providing pivotal connection between the side member and the second frame structure about an axis substantially aligned with the axis of the pivotal connction provided by said second pivot means.

4. The improvement as set forth in claim 3, further comprising position holding means for holding said first frame structure in a proper fore-and-aft position with respect to said frame structure, said position holding means comprising a position retaining member rotatably mounted on said first frame structure on and about an axis extending in a lateral direction of the first frame structure and fixed with respect to the first frame structure, a retaining element secured on said side member, said retaining member being selectively engageable with said retaining element for preventing said first frame structure from being angularly moved out of said proper position away from said second frame structure about the axis of the pivotal connection provided by said first pivot means, and biasing means for urging said retaining member into operative engagement with said retaining element.

5. The improvement as set forth in claim 4, in which said position holding means further comprises a stop element secured on said side member, said position retaining member being engageable with said stop element for preventing the first frame structure from being angularly moved out of said proper position toward said second frame structure about the axis of the pivotal connection provided by said first pivot means.

6. The improvement as set forth in any one of claims 1 to 5, in which said printing apparatus is of the back-impact type having a type carrier mounted on said first frame structure and having said impact hammers mounted on said second frame structure.

7. The improvement as set forth in any one of claims 1 to 5, in which said printing apparatus is of the back-impact type and wherein said impact hammers are operatively mounted on said first frame structure, and a type carrier mounted on said second frame structure.

8. The improvement as set forth in any one of claims 1 to 5, in which said printing apparatus is of the front-impact type and wherein a platen is mounted on said first frame structure, and wherein both said impact hammers and type carrier are mounted on said second frame structure.

9. The improvement as set forth in any one of claims 1 to 5, in which said printing apparatus is of the front-impact type and wherein said impact hammers and type carrier are both operatively mounted on said first frame structure, and a platen mounted on said second frame structure.

* * * * *